United States Patent [19]

Worman

[11] 3,997,234

[45] Dec. 14, 1976

[54] PLUG PACKAGE HANDLE

[75] Inventor: Jared Nathan Worman, Camp Hill, Pa.

[73] Assignee: AMP Incorporated, Harrisburg, Pa.

[22] Filed: Feb. 17, 1976

[21] Appl. No.: 658,216

[52] U.S. Cl. ..... 339/105; 339/108 R

[51] Int. Cl.[2] ..... H01R 13/62

[58] Field of Search ..... 339/45, 46, 58, 103, 339/105, 108; 29/203 R, 203 S

[56] References Cited

UNITED STATES PATENTS

| | | | |
|---|---|---|---|
| 1,065,190 | 6/1913 | Tobin | 339/105 |
| 3,419,670 | 12/1968 | Schneider | 339/105 |
| 3,740,698 | 6/1973 | Jerominek | 339/103 M |

*Primary Examiner*—Joseph H. McGlynn
*Attorney, Agent, or Firm*—Russell J. Egan

[57] ABSTRACT

A handle is disclosed to secure two or more groups of plugs together as a unit for insertion and extraction into and out of high density arrays of receptacles. The handle includes means to grip the groups of plug members as well as strain relief means for the conductors leading to the plugs. Thus the handle provides an easy way to manipulate two or more groups of plugs, with gap spacing therebetween if necessary, as a single unit.

2 Claims, 4 Drawing Figures

PLUG PACKAGE HANDLE

BACKGROUND OF THE INVENTION

1. The Field Of The Invention

The present invention relates to a handle for use in inserting and extracting two or more groups of plugs as a single unit and in particular to a handle forming a single unit from groups of plugs having gap spacing between at least two groups of plugs.

2. The Prior Art

The present invention relates to a handle for use with plugs of the type described in U.S. Pat. Nos. 3,874,763 and 3,901,575. It is often desirable to use groups of plugs such as those described in the above-mentioned patents in a various patterned configuration with a gap formed between adjacent groups of plugs. The individual groups of plugs could be handled separately, but this can cause problems in misalignment plus a great deal of tedium in simply making the extra insertions and extractions, especially in high density arrays.

SUMMARY OF THE INVENTION

The present invention concerns a handle for use with at least two groups of plugs, having gap spacing between the groups, for insertion and extraction of the groups of plugs as a unit in a high density array of receptacles. The handle includes a plurality of first fingers extending in the plane of the handle and defining therebetween a plurality of plug receiving cavities and a second plurality of fingers normal to said first fingers defining a channel extending transverse to the axis of the plugs and adapted to receive therein a web interconnecting the individual plugs of each group. The handle further includes conductor strain relief means.

It is therefore an object of the present invention to produce a handle to accommodate a plurality of groups of plugs in a spaced gap arrangement for insertion into and extraction from a high density array of receptacles as a unit.

It is a further object of the present invention to produce a handle which can be secured to two or more groups of plugs so that the groups of plugs can be handled as a unit.

It is a further object of the present invention to produce a handle which will accommodate groups of plugs and provide strain relief for the conductors leading to the plugs.

It is a further object of the present invention to provide a plug handle which can be readily and economically produced.

The means for accomplishing the foregoing objects and other advantages of the present invention will become apparent from the following detailed description taken with reference to the accompanying drawings.

DETAILED DESCRIPTION OF THE PREFERRED EMBODIMENT

Figure 1:
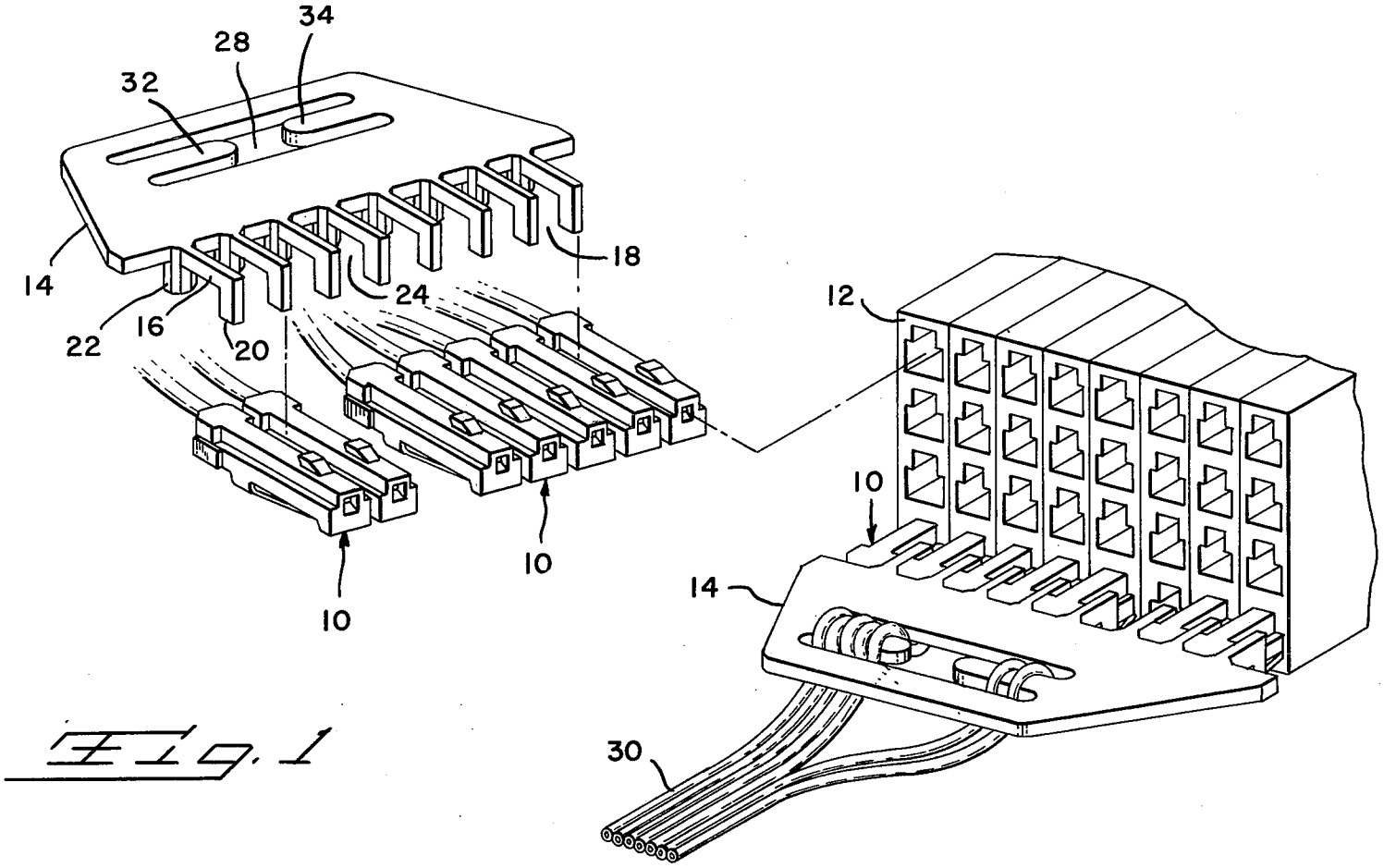
FIG. 1 is an exploded perspective view showing a first plug handle with first and second groups of plugs mounted therein and inserted into corresponding receptacle and a second plug handle with third and fourth groups of plugs exploded therefrom.
Figure 2:
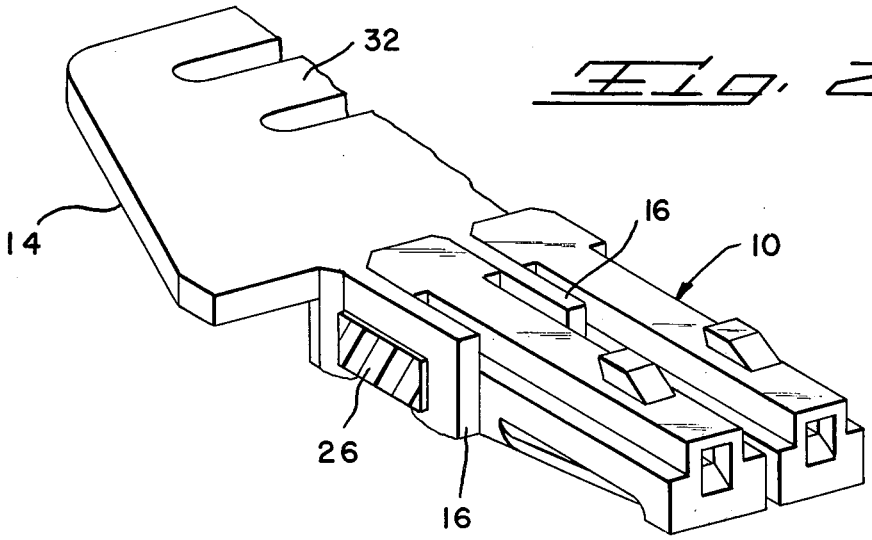
FIG. 2 is a perspective view of a fragment of the subject plug handle.

FIG. 1 shows a plurality of groups of plugs 10 of the type described in U.S. Pat. No. 3,901,575. These plugs are adapted to be received within a high density receptacle 12 of the type described in U.S. Pat. Nos. 3,439,314 and 3,538,489. The subject plug handle 14 is adapted to engage and secure at least two groups of plugs 10 so that they may be operated as a unit. The handle 14 can be molded of nylon, or other rigid plastics material, and includes a plurality of first finger members 16 extending in the plane thereof and defining therebetween a plurality recesses 18 adapted to receive the plugs 10 therein. At the free end of each first finger 16 is a second finger 20 extending normal to the first finger and at the root of each first finger there is a third finger 22 extending normal to the plane of the handle. The second and third fingers define therebetween a channel 24 extending transverse to the axes of the plugs and are adapted to receive therein the web 26 interconnecting the individual plugs of each group. This can best be seen in FIG. 2.

The handle further includes strain relief means comprising a substantially H-shaped slot 28 spaced to the rear of the handle. The strain relief function is provided by wrapping the conductors 30 around the middle bars 32, 34 of the slot 28 as shown in FIGS. 1 and 3.

Figure 3:
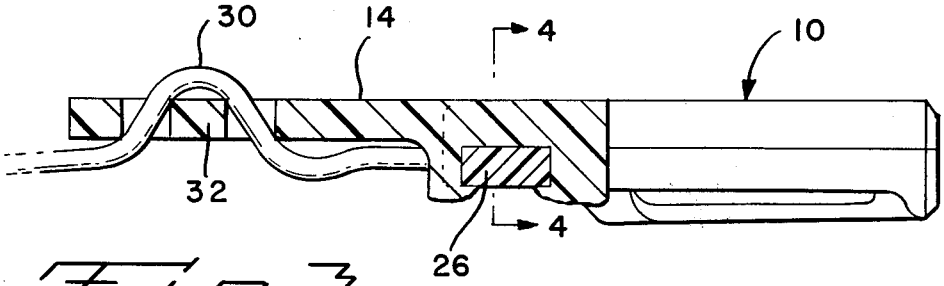
FIG. 3 is a section through the subject plug handle.
Figure 4:
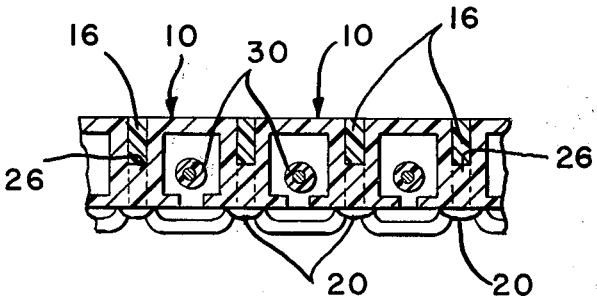
FIG. 4 is a section taken along line 4—4 of FIG. 3.

The groups of plugs are preferably secured in the handle by ultrasonic bonding means (not shown) heating and deforming the ends of the second and third fingers into a bonding engagement with the web of the plugs, as shown in FIG. 3. In the alternative, the groups of plugs could be bonded to the handle by any of the well known adhesives compatable with the handle and plug materials. As a further alternative, either or both of the second and third fingers could be provided with detents and/or projections (not shown) to effect a latching with the groups of plugs by engaging either or both of the web or the plugs themselves.

The present invention may be subject to many modifications and changes without departing from the spirit or essential characteristics thereof. The present embodiments are therefore to be considered in all respects as illustrative and not restrictive of the scope of the invention.

What is claimed is:

1. A handle for supporting at least two groups of plugs in fixed spaced relation for unitary operation in insertion into and extraction from high density arrays of receptacles, each said group of plugs having a plurality of plugs secured to a web in fixed parallel spaced relation, said handle comprising:

a substantially planar body member of rigid insulator material with a plurality of parallel first fingers extending in the plane of said body member along one edge portion thereof and defining therebetween a plurality of plug receiving cavities, means to secure groups of plugs in said cavities, and an H-shaped slot in said body member spaced from said one edge portion to define a pair of opposed cross bars extending parallel to said edge portion whereby strain relief is provided for conductors connected to said plugs by threading the conductors through said slots and about at least one of said cross bars.

2. A handle according to claim 1 wherein said means to secure groups of plugs in said cavities comprises:

a pair of spaced, parallel fingers extending from said first fingers normal to the plane of said body member, said pair of fingers defining therebetween a web receiving channel extending normal to the axes of said cavities, said web of said groups of plugs being positioned in said web receiving channel and the ends of said pair of fingers deformed against said web to secure said groups of plugs in said handle.

* * * * *